United States Patent [19]

Fink

[11] 4,003,098

[45] Jan. 18, 1977

[54] INFLATABLE CRIB

[76] Inventor: Leonard Fink, 7868 Southern Blvd., Youngstown, Ohio

[22] Filed: Nov. 10, 1975

[21] Appl. No.: 630,740

[52] U.S. Cl. ..... 5/93 R; 5/98 R

[51] Int. Cl.[2] ..... A47D 7/00

[58] Field of Search ..... 5/94–98, 5/327; 297/456; 5/93, 94, 98

[56] References Cited

UNITED STATES PATENTS

| | | | |
|---|---|---|---|
| 2,505,845 | 5/1950 | Alvarez | 5/9 R |
| 3,049,728 | 8/1962 | Lund | 5/98 R |
| 3,323,147 | 6/1967 | Van Dean | 5/98 R |
| 3,513,489 | 5/1970 | Miller et al. | 5/98 R |
| 3,619,825 | 11/1971 | Taub et al. | 5/97 R |

*Primary Examiner*—Paul R. Gilliam
*Assistant Examiner*—Andrew M. Calvert
*Attorney, Agent, or Firm*—Webster B. Harpman

[57] ABSTRACT

A lightweight portable inflatable structure in the form of a baby's crib has a base portion and upstanding side walls integrally formed thereabout in communication therewith. Interconnecting webs formed by heat sealing the air impervious sheet material from which the inflatable structure is formed assist in controlling the size and shape of the inflatable structure and a separate rigid rectangular frame and supporting legs detachably supports the inflatable structure to prevent collapse in the event of loss of air pressure therefrom.

6 Claims, 6 Drawing Figures

INFLATABLE CRIB

BACKGROUND OF THE INVENTION

1. Field of the Invention

This invention relates to inflatable structures and more particularly wherein such a structure takes the form of a baby's crib.

2. Description of the Prior Art

Inflatable structural articles have been known in a number of different forms for various purposes. For instance inflatable swimming pools having upstanding inflatable side walls may be seen in U.S. Pat. Nos. 2,443,440 and 3,631,544. A water bed stand which is similar to an inflatable structural device is seen in U.S. Pat. No. 3,724,008 and an inflatable hood or covering is seen in connection with a baby carriage in U.S. Pat. No. 3,799,606. Inflatable mattress cribs with bumper pads and the like are seen in U.S. Pat. Nos. 3,527,116 and 3,803,646.

This invention provides an inflatable structural component in the form of a baby's crib which may be formed of lightweight vinyl sheeting for example, heat seamed to form an air tight enclosure of a desired size and shape which is readily collapsed and re-inflated for portability and provided with a quickly assembled lightweight rigid frame that acts to support the inflatable structure in the event of deflation.

SUMMARY OF THE INVENTION

An inflatable structure in the form of a crib for babies includes a base section in the form of an air mattress and four upstanding side walls attached thereto and in communication therewith. The base portion and the side walls are provided with heat sealed seams which terminate inwardly of the edges of the several portions of the crib structure and provide an intercommunicating means for inflation of the device or deflation thereof from a common passageway equipped with an air valve.

DESCRIPTIONOF THE PREFERRED EMBODIMENT

Figure 1:
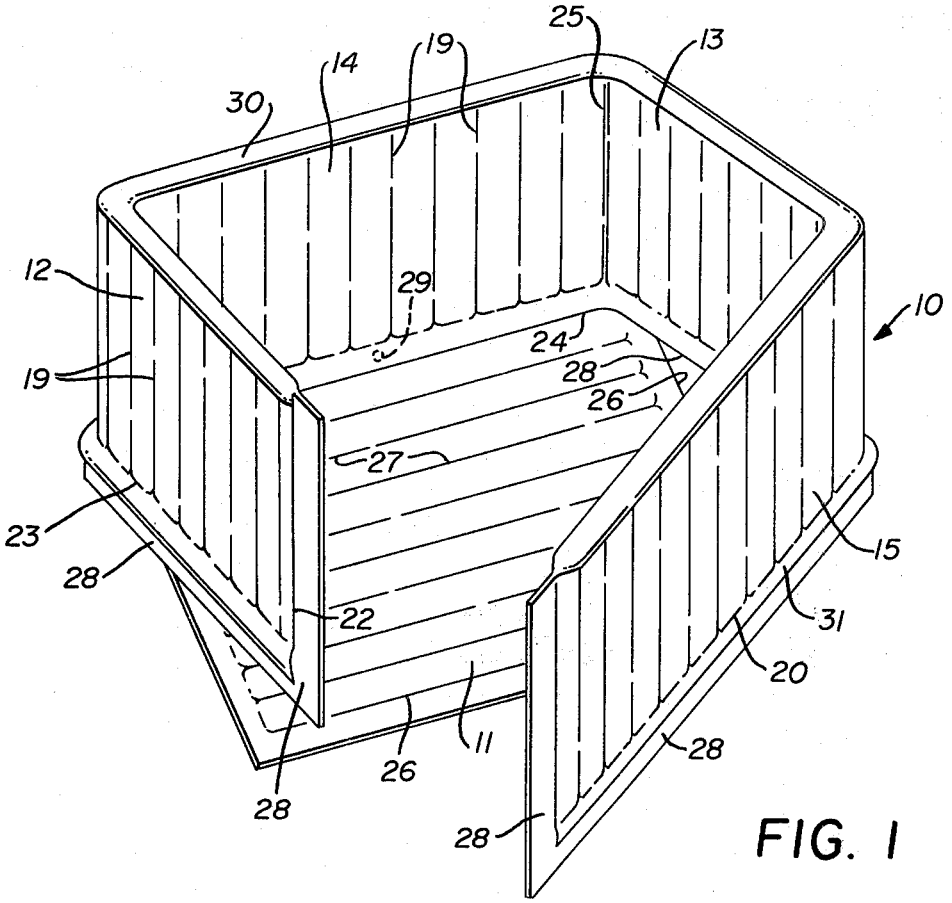
FIG. 1 is a perspective elevation of the inflatable structure prior to its final assembly.
Figure 2:
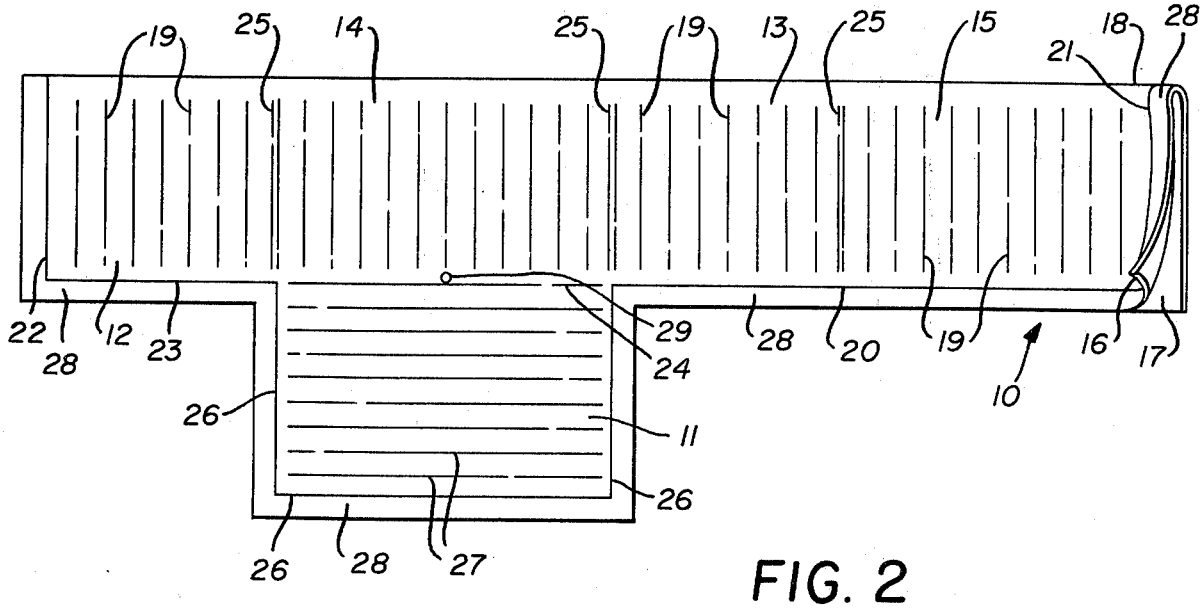
FIG. 2 is a plan view of the inflatable structure prior to the shaping assembly seen in FIG. 1.

By referring to the drawings and FIG. 1 in particular, it will be seen that an inflatable structure in the form of a baby's crib 10 is illustrated. It is formed of air impervious sheet material and takes the form of an inflatable base or air mattress 11 and four wall sections including end walls 12 and 13 and side walls 14 and 15. As seen in FIGS. 1 and 2 of the drawings, the base section and wall sections are formed of a single doubled section of air impervious heat sealable plastic sheet material such as vinyl sheeting or the like. In the lower right hand corner of FIG. 2 the upper and lower portions of the sheet material may be seen and they are indicated by he numerals 16 and 17 respectively.

The single section of sheet material from which these upper and lower portions are formed is folded upon itself along a fold line 18 and a plurality of transversely extending heat sealed seams 19 are formed inwardly of the fold line 18 and inwardly with respect to a longitudinally extending heat sealed seam 20 along the edges of the material. Each of the ends of the folded section of sheet material are heat sealed inwardly of their actual end portions by transverse seams 21 and 22 and a secondary longitudinal seam 23 is formed on the lower portion of the end portion 12 as seen in FIG. 2 of the drawings and a similar but spaced continuation of the longitudinal seams 20 and 23 extends along the portion of the inflatable structure which forms the side wall 14 and this seam is indicated by the numeral 24.

The transverse seams wich separate the end sections 12 and 13 from the side wall portions 14 and 15 are preferably double heat sealed as indicated at 25 and these double heat seal seams extend from a point inwardly of the fold line 18 to points adjacent the longitudinal seams 20, 23 and 24 heretofore described.

The lowermost portion of the doubled sheet material as still seen in FIG. 1 of the drawings, forming the base or air mattress portion 11 of the device, has a U-shaped heat sealed seam 26 and a plurality of longitudinally extending heat sealed seams 27, the ends of which are spaced inwardly from the oppositely disposed portions of the U-shaped heat sealed seam 26. The arrangement and sealing of the portions of the device as hereinbefore described forms a continuous air tight seal between the doubled portions of the sheet material as defined by the transverse heat sealed seams 21 and 22 and the longitudinally extending heat sealed seams 20 and 23 and the intermediate U-shaped heat sealed seam 26 and it will be seen that the continuous edge seam thus formed inwardly of the several edges of the folded material leaves an edge flap 28 on the opposite ends of the longitudinal section of the blank as seen in FIG. 1 and on the ends of the base section 11 and the longitudinal side thereof. An air valve 29 is positioned in the edge of the side wall portion 14 and air introduced thereinto inflates the entire structure and provides the necessary degree of rigidity due to the plurality of heat sealed seams 19 and 27.

By referring now to FIG. 2 of the drawings it will be seen that the heat sealed double wall section in partially inflated condition is illustrated and wherein the flaps 28 are not yet joined to one another. The device as partially assembled in FIG. 2 may be easily completed by heat sealing the several flaps 28 to one another and specifically at the base of the end wall 13, at the base of the side wall 15 and at the base of the end wall 12. The final heat seal is run vertically between the flaps 28 on the ends of the side wall 15 and the end wall 12 respectively and by referring to FIG. 3 of the drawings the completed inflatable structure may be seen. The inward spacing of the heat sealed seams 10 cause the inflated structure to define an upper rectangular rolled edge 30 and a similar inflated lower rolled edge 31 and it will be seen that the construction is such that the lower rolled edge 31 is larger than the upper rolled edge 30 so tht the increased width of the base or air mattress portion 11 lends stability to the inflatable crib structure.

Figure 4:
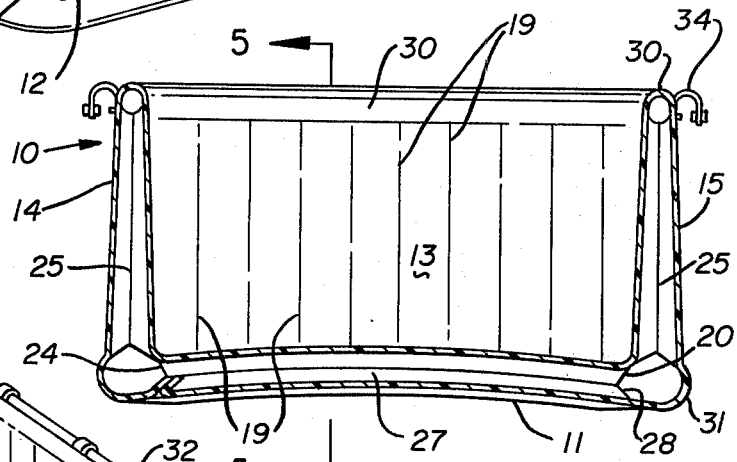
FIG. 4 is a vertical section on line 4—4 of FIG. 3.
Figure 5:
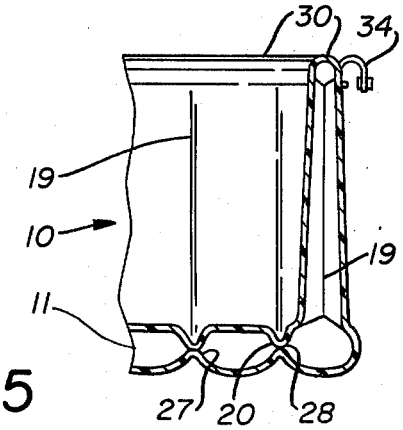
FIG. 5 is a vertical section on line 5—5 of FIG. 4.

In FIGS. 4 and 5 vertical sections through the inflated structure may be seen and it will be observed that the relative size of the rolled edges 30 and 31 may be seen as well as the arrangement of the heat sealed seams 19 and 27 which enable the inflatable structure to retain the desired shape.

Figure 3:
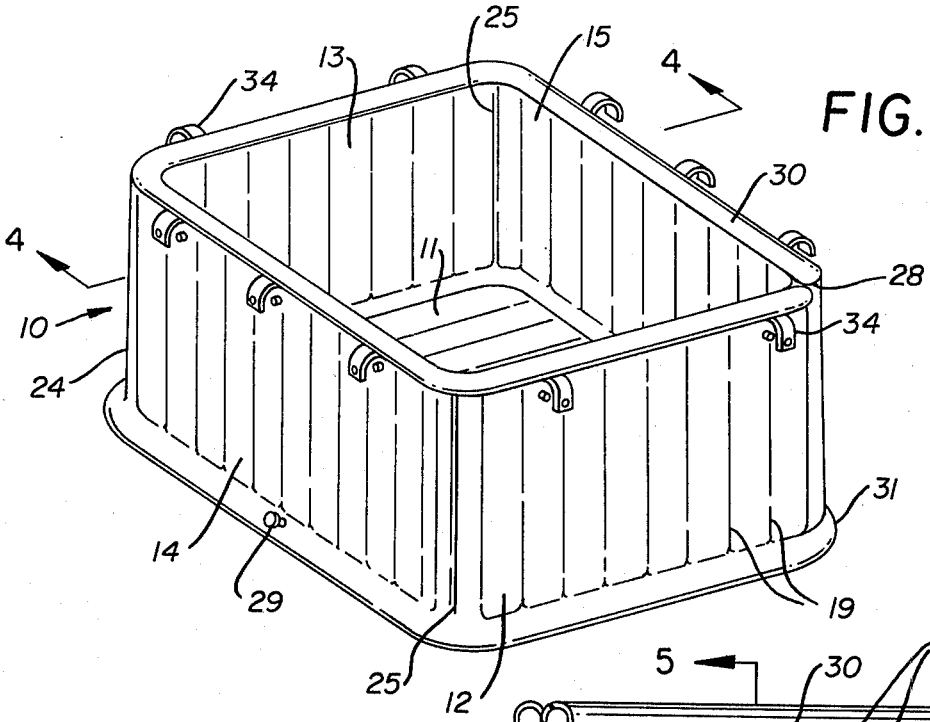
FIG. 3 is a perspective view of the inflatable structure in inflated condition.
Figure 6:
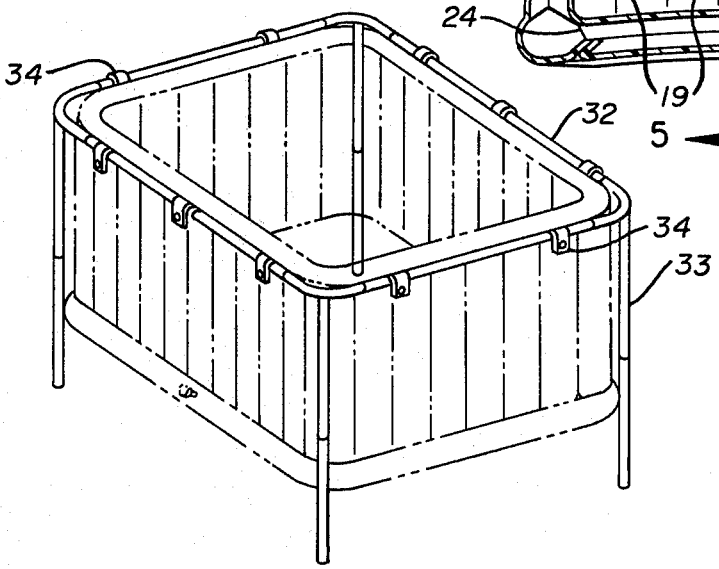
FIG. 6 is a perspective elevation of a lightweight multiple part rigid frame with broken lines indicating the positioning of the inflatable crib of FIG. 3 positioned therein and detachably connected thereto.

By referring now to FIG. 6 of the drawings, a broken line elevation of the inflated crib of FIG. 3 of the drawings, may be seen supported by a demountable lightweight rigid frame which comprises a rectangular multi-section portion 32 and a plurality of multi-portion legs 33 which may be engaged one in the other in telescopic relation. A plurality of straps 34 are attached to the outer side of the upper rolled edge 30 of the inflatable crib and provided with snap fasteners which have registering parts also secured to the inflatable crib structure. These straps 34 when looped over the rectangular frame 32 serve to hold the side walls of the cribe in upstanding position even though the air is accidentally or deliberately lost from the inflated structure. By varying the height of the legs 33 the frame can position the crib on a bed or other support or alternately when the leg length is increased the same supports the inflatable crib in elevated relation to a supporting surface such as a floor.

It will thus be seen that an inflatable structure taking the form of a baby's crib has been disclosed which is lightweight, readily portable and can be inexpensively formed of sheet vinyl material, for example, and lightweight metal or plastic frame members for the supporting frame and that the inflatable crib when used in conjunction with the frame is entirely safe as accidental deflation of the inflatable structure will not result in the collapse of the same upon a baby sleeping therein.

Although but one embodiment of the present invention has been illustrated and described it will be apparent to those skilled in the art that various changes and modifications may be made therein without departing from the spirit of the invention or from the scope of the appended claims and having thus described my invention.

What I claim is:

1. An inflatable structure in the form of a baby's crib having a base portion and vertical side walls attached to the outermost edges thereof and in communication therewith, an opening in said inflatable structure and an air valve in said opening, said base portion having a plurality of longitudinally extending heat sealed seams therein terminating substantially inwardly of the ends and sides thereof so as to define a plurality of air passageways therebetween and communicating air passageways at the ends and sides thereof together with a peripheral flap therearound, a plurality of secondary heat sealed seams in said side walls terminating substantially inwardly of the upper and lower edges thereof so as to define continuously extending enlarged inflatable upper and lower rolled edge portions on said side walls and a plurality of inflatable interconnecting areas therebetween and flaps extending outwardly thereof, said flaps on said enlarged lower rolled edge portions of said side walls continuously joined to said peripheral flap around said base portion so that said vertical side walls are located inwardly of the outermost sections of said enlarged lower rolled edge portions thereof.

2. The inflatable structure of claim 1 and wherein the structure is formed of a section of flexible sheet material doubled upon itself on a longitudinal fold line, and closed at its edges to form an airtight envelope.

3. The inflatable structure of claim 1 and wherein the structure is formed of a least two similarly shaped sections of flexible sheet material defining said side walls and said base portion and arranged for interconnection so as to be inflatable from said opening.

4. The inflatable structure of claim 1 and wherein the closed edges have extending flaps therealong with the flaps on the ends of the side walls attached to one another to form a right angular corner in the upstanding side walls.

5. The inflatable structure of claim 1 and wherein a plurality of fasteners are affixed to the upper rolled edge portions of the upstanding side walls and a lightweight rigid frame having supporting legs is positioned around said side walls and detachably affixed thereto by said fasteners so as to hold said sidewalls in upstanding position when deflated.

6. The inflatable structure of claim 1 and wherein the combined base portion is wider than the overall width of the structure thereabove defined by said upstanding side walls.

* * * * *